US011752647B2

(12) United States Patent
Johnson

(10) Patent No.: US 11,752,647 B2
(45) Date of Patent: Sep. 12, 2023

(54) HAIR CLIPPER BLADESET WITH COMBINED DRIVE ELEMENTS

(71) Applicant: WAHL CLIPPER CORPORATION, Sterling, IL (US)

(72) Inventor: Bruce V. Johnson, Sterling, IL (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 0 days.

(21) Appl. No.: 17/804,241

(22) Filed: May 26, 2022

(65) Prior Publication Data

US 2022/0395993 A1 Dec. 15, 2022

Related U.S. Application Data

(60) Provisional application No. 63/209,779, filed on Jun. 11, 2021.

(51) Int. Cl.
*B26B 19/02* (2006.01)
*B26B 19/28* (2006.01)

(52) U.S. Cl.
CPC ..... *B26B 19/02* (2013.01); *B26B 19/282* (2013.01)

(58) Field of Classification Search
CPC ..... B26B 19/00; B26B 19/02; B26B 19/04; B26B 19/042–048; B26B 19/28; B26B 19/282; B26B 19/284
See application file for complete search history.

(56) References Cited

U.S. PATENT DOCUMENTS 2,704,887 A * 3/1955 Andis ..... B26B 19/06 30/224
5,068,966 A 12/1991 Wahl et al.
6,559,563 B1 * 5/2003 Shimizu ..... B26B 19/282 310/12.13

(Continued)

FOREIGN PATENT DOCUMENTS

CN 208826676 U 5/2019
WO 2020210043 A1 10/2020

OTHER PUBLICATIONS

International Search Report and Written Opinion received for PCT/US2022/031158, dated Sep. 22, 2022.

*Primary Examiner* — Adam J Eiseman
*Assistant Examiner* — Richard D Crosby, Jr.
(74) *Attorney, Agent, or Firm* — Greer, Burns & Crain, Ltd

(57) ABSTRACT

A hair clipper bladeset includes a stationary blade having a front, stationary toothed edge and an opposite, stationary rear edge, the stationary blade defining a transverse track, a moving blade having a front, moving toothed edge and an opposite, moving rear edge, and a lower blade guide disposed between the moving blade and the stationary blade and configured for reciprocating in the track and maintaining lateral alignment of the moving blade relative to the stationary blade during lateral reciprocating movement of the moving blade. The moving blade has an engagement formation. An upper blade guide connects with the engagement formation for moving with the moving blade in the lateral reciprocating movement. A drive arm has a blade end operatively engaging the upper blade guide, and an opposite follower end configured for receiving a hair clipper drive element, the drive arm pivots about a drive post located on the stationary blade.

20 Claims, 11 Drawing Sheets

(56) References Cited

U.S. PATENT DOCUMENTS

| | | | | |
|---|---|---|---|---|
| 8,079,149 | B2 * | 12/2011 | Bednar | B26B 19/288 30/223 |
| 8,132,332 | B2 * | 3/2012 | Tautscher | B26B 19/06 30/208 |
| 8,806,757 | B2 | 8/2014 | Moseman | |
| 9,545,729 | B2 | 1/2017 | Buck, Jr. et al. | |
| 10,093,029 | B2 * | 10/2018 | Sablatschan | B26B 19/3846 |
| 10,272,578 | B2 * | 4/2019 | Johnson | B26B 19/06 |
| 10,919,165 | B2 * | 2/2021 | Hoexum | B26B 19/3846 |
| 11,148,307 | B2 * | 10/2021 | Werner | B26B 19/3846 |
| 2011/0265331 | A1 * | 11/2011 | Moseman | B26B 19/205 30/286 |
| 2014/0259689 | A1 * | 9/2014 | Lau | B26B 19/3846 30/241 |
| 2016/0075039 | A1 * | 3/2016 | Werner | B26B 19/06 30/200 |
| 2018/0126570 | A1 * | 5/2018 | Werner | B26B 19/3846 |
| 2020/0180175 | A1 | 6/2020 | Petrelli et al. | |
| 2021/0094195 | A1 | 4/2021 | Phoon et al. | |

* cited by examiner

HAIR CLIPPER BLADESET WITH COMBINED DRIVE ELEMENTS

RELATED APPLICATION

This application is a Non-Provisional of, and claims the benefit under 35 U.S.C. 119(e) from, U.S. Provisional Application Ser. No. 63/209,779 filed Jun. 11, 2021, the contents of which are incorporated by reference herein.

BACKGROUND

The present invention relates to hair clipper bladesets, and more particularly to such bladesets used, for non-limiting example, on relatively high-powered hair clippers used for shearing and/or trimming animal fur or hair. The teachings herein can be readily applied to electrically operated hair clippers for animal or human use.

Conventional electric hair clippers are known to include a stationary blade having a front-facing toothed edge, and a transversely reciprocating moving blade, also with a toothed edge that slides back and forth relative to the stationary blade toothed edge, clipping hairs caught between the moving and stationary teeth. In the case of hair clippers used for trimming or shearing animals, the thick hair or fur is difficult to cut, even with relatively higher powered motors than those typically used for trimming human hair, and often obliges the user to exchange bladesets more frequently. However, conventional clippers used for trimming animals are configured so that the bladesets are assembled on the clipper, requiring a relatively time-consuming assembly process. During high volume animal shearing operations, precious time is lost while dull bladesets are exchanged for sharp replacements.

Another drawback to conventional hair clipper bladesets is that once disassembled from the main clipper housing, the various components are easily lost. The constituent pieces tend to be small, and in many cases are assembled spring-loaded, such that they may spring apart when disassembled.

Still another drawback of conventional hair clippers, particularly those used for shearing and/or trimming animals, is that the hair clipper, when equipped with a more powerful professional-level electric motor for properly cutting through thick animal fur, draws a substantial amount of electrical power.

Accordingly, there is a need for an improved hair clipper bladeset that addresses the drawbacks listed above.

SUMMARY

The above-listed need is met or exceeded by the present hair clipper bladeset with combined drive elements. A feature of the present bladeset is that it remains assembled even after detachment from the hair clipper housing. Only two fasteners, preferably screws, are needed to secure the entire bladeset as a unit to the hair clipper. Thus, a user can more rapidly exchange bladesets during a clipping/shearing operation.

Another feature of the present bladeset is the incorporation of a blade guide assembly that includes a lower blade guide and an upper blade guide, the latter of which accommodates a drive arm which pivots relative to the stationary blade about a drive post or pivot pin that is based on the stationary blade. Accordingly, the present bladeset includes a stationary blade, a lower blade guide, a moving blade sandwiching the lower bade guide against the stationary blade, an upper blade guide, and a drive arm engaging the upper blade guide. The drive arm is pivotally secured to a drive post that is operationally secured to the stationary blade. In a preferred embodiment, a bushing connects the drive arm to the drive post in a way that reduces operational friction. Thus, all of the above-listed bladeset components are releasably assembled to the hair clipper as a unit.

Still another feature of the present bladeset is that the present bladeset includes the above-identified drive arm that operates at a ratio of 3:1, meaning that a movement of the drive cam by 0.055 inch generates a blade movement of 0.165 inch. As such, a given horsepower motor in the hair clipper housing generates more torque and consequential hair clipping action by using the present hair clipper bladeset. Alternatively, a smaller motor may be used, resulting in a more compact hair clipper housing, which is as much as 2.5 pounds lighter and/or 40% shorter is capable of producing the same cutting power as heavier and longer conventional hair clippers that utilize larger motors. In addition, by reducing components of the bladeset compared to conventional hair clipper bladesets, the present bladeset operates with reduced vibration.

It has been found that the present bladeset generates less vibration than conventional units due to the following factors: reduced vibration of the cam due to closer tolerances between the drive arm and the hair clipper drive cam, a lighter weight moving blade produced by stamping, so that reciprocating mass is reduced, and an optional ball bearing interface between the lower blade guide and the stationary blade. Also, the present bladeset features a main spring that biases the moving blade against the stationary blade.

More specifically, a hair clipper bladeset is provided, including a stationary blade having a front, stationary toothed edge and an opposite, stationary rear edge, the stationary blade defining a transverse track, a moving blade having a front, moving toothed edge and an opposite, moving rear edge, and a lower blade guide disposed between the moving blade and the stationary blade and configured for reciprocating in the track and maintaining lateral alignment of the moving blade relative to the stationary blade during lateral reciprocating movement of the moving blade. The moving blade has an engagement formation. An upper blade guide connects with the engagement formation for moving with the moving blade in the lateral reciprocating movement. Also included in the bladeset is a drive arm having a blade end operatively engaging the upper blade guide, and an opposite follower end configured for receiving a hair clipper drive element, and the drive arm pivots about a drive post located on the stationary blade.

In an embodiment, a surface of the stationary blade is provided with grooves accommodating at least one ball bearing for reducing friction generated by the reciprocation of the lower blade guide relative to the stationary blade.

In a preferred embodiment, the engagement formation of the moving blade is an opening accommodating a depending lug in the upper blade guide. Also, the upper blade guide includes a slot for accommodating the blade end of the drive arm. Preferably, the follower end of the drive arm defines an interior configured for receiving the hair clipper drive cam.

In an embodiment, a bushing is slidably and rotatably mounted on the drive post, and the interior is dimensioned to be sufficiently large for accommodating the bushing. The stationary blade includes a socket dimensioned for accommodating a lower end of the drive post. Also, a spring is provided that is configured for urging the moving blade against the stationary blade.

In an embodiment, the drive arm operates at a ratio of 3:1 relative to the moving blade, such that a movement of the drive cam by 0.055 inch generates a blade movement of 0.165 inch.

In an embodiment, the upper blade guide is provided with depending tabs that slidingly engage grooves in the stationary blade for maintaining the alignment of the moving blade relative to the stationary blade. In another embodiment, the stationary blade is provided with a concave shape when viewed from the side to reduce friction with the lower blade guide in the transverse track.

In another embodiment, a hair clipper is provided, including a clipper housing, a drive system mounted within the clipper housing, the drive system including an eccentric cam. A hair clipper bladeset is provided, including a stationary blade having a front, stationary toothed edge and an opposite, stationary rear edge, the stationary blade defining a transverse track, a moving blade having a front, moving toothed edge and an opposite, moving rear edge, and a lower blade guide disposed between the moving blade and the stationary blade and configured for reciprocating in the track and maintaining lateral alignment of the moving blade relative to the stationary blade during lateral reciprocating movement of the moving blade. The moving blade has an engagement formation. An upper blade guide connects with the engagement formation for moving with the moving blade in the lateral reciprocating movement. Also included in the bladeset is a drive arm having a blade end operatively engaging the upper blade guide, and an opposite follower end configured for receiving the eccentric cam, and the drive arm pivots about a drive post located on the stationary blade.

DETAILED DESCRIPTION

Figure 1:
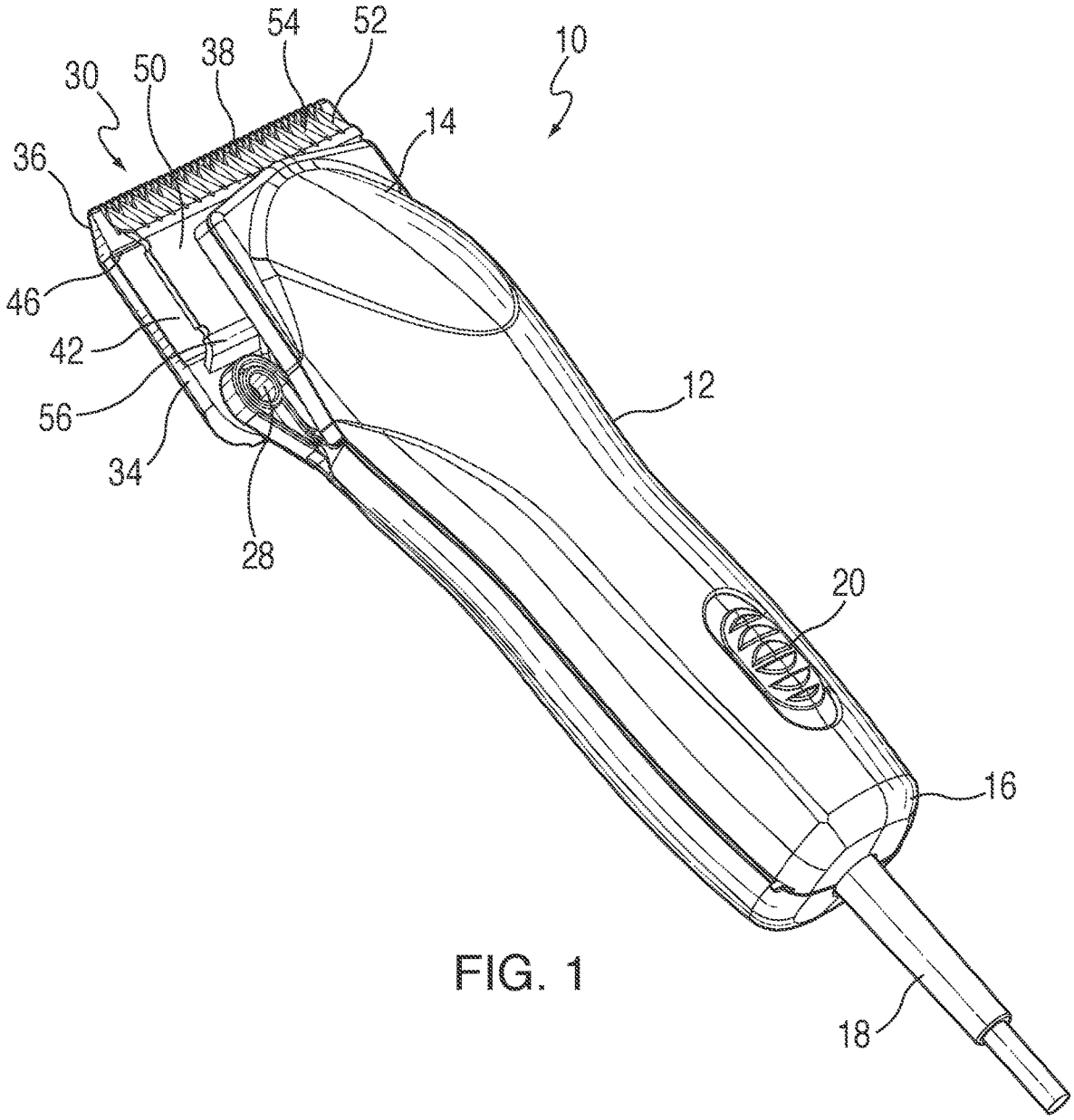
FIG. 1 is a perspective view of a hair clipper utilizing a first exemplary embodiment of a bladeset according to the teachings herein.
Figure 2:
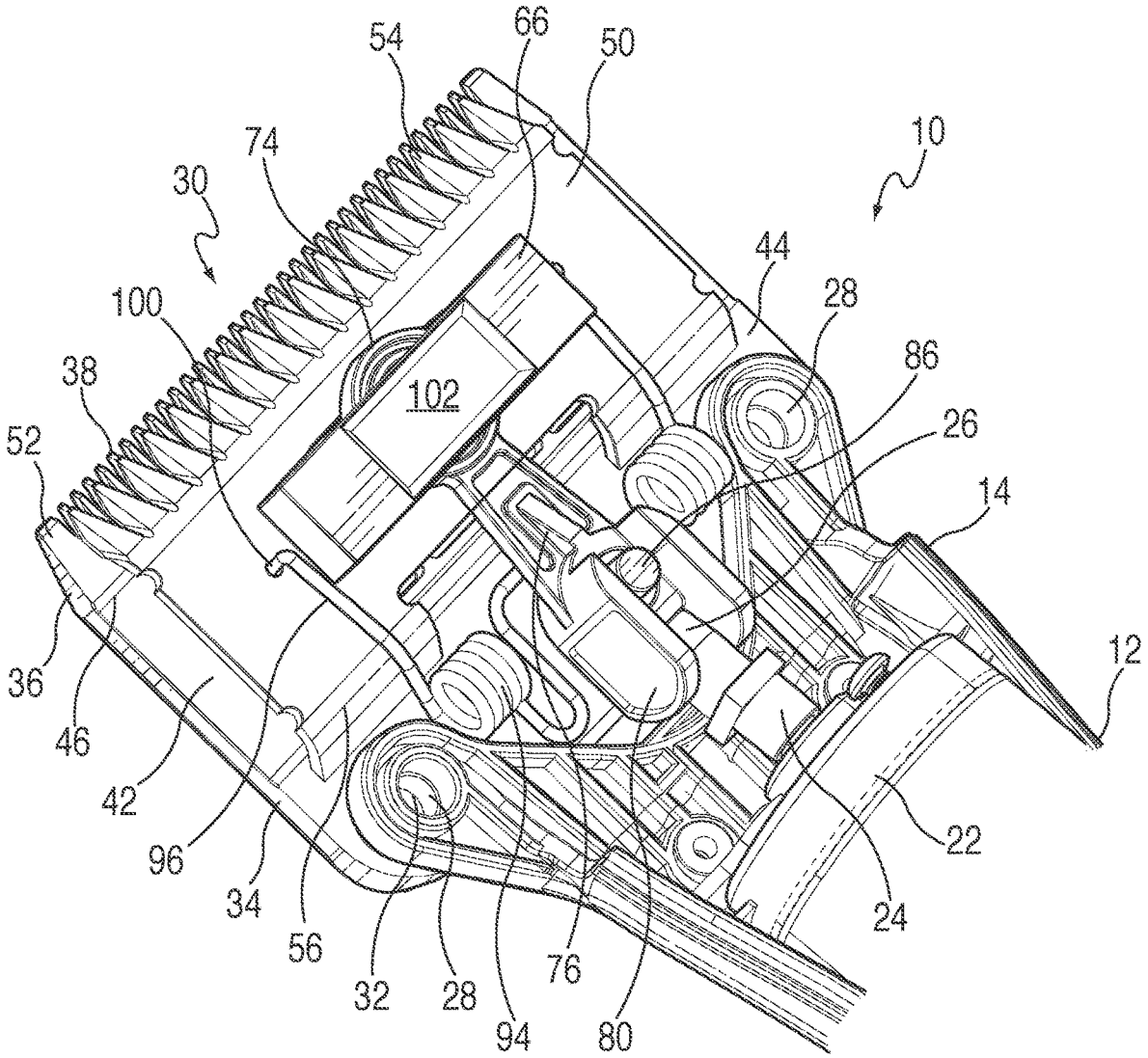
FIG. 2 is a fragmentary perspective view of the hair clipper of FIG. 1, illustrating a mating interface between an eccentric cam element and a cam follower of the first exemplary embodiment of the bladeset.
Figure 3:
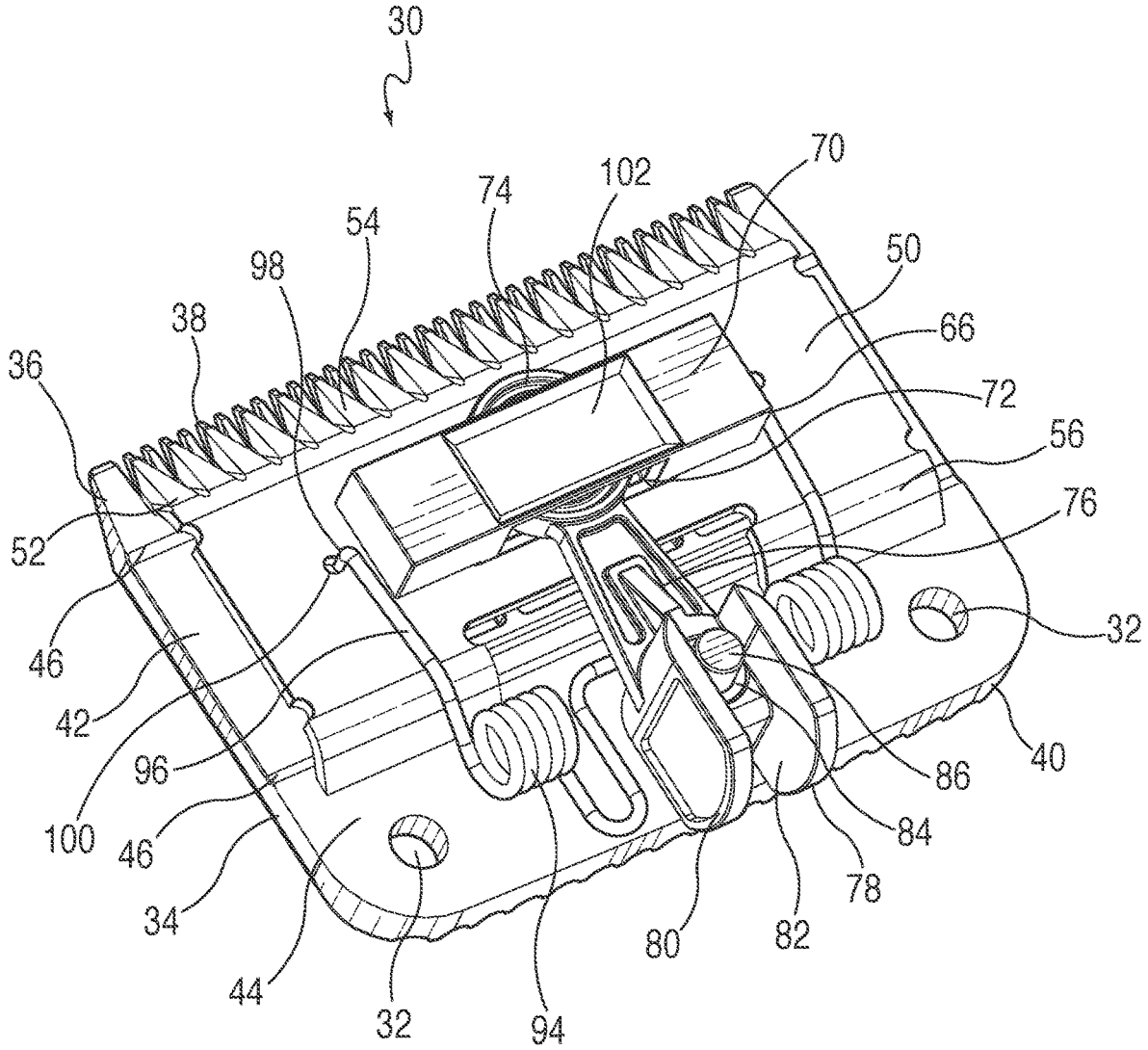
FIG. 3 is a top perspective view of the bladeset of FIG. 1.

Referring now to FIGS. 1 and 2, a hair clipper is generally designated 10, and is of the type designed for use in trimming animal hair or fur. However, for the purposes of the present disclosure, any type of electric hair clipper is envisioned, including but not limited to models which are designed for cutting human hair. Further, while the teachings herein are described in the context of a hair clipper, it is also envisioned that the same could be applied in the context of a hair trimmer. As such, any reference herein to a hair clipper should be taken to include hair trimmers as well. Included on the hair clipper 10 is a clipper housing 12 having a blade end 14 and an opposite, rear end 16. A suitable power cord 18 is provided for making electrical contact with conventional wall sockets, however battery powered clippers are contemplated as are known in the art. A user-activated power switch 20 turns the hair clipper 10 on and off as is known in the art. The clipper housing 12 encloses a motor 22 generating rotary motion that is transmitted through an eccentric cam 24 having a drive end 26 which will be described in further detail below. This motor may be brushed or brushless. Included on the housing 12 at the blade end 14 is a pair of mounting openings 28.

Referring now to FIGS. 1-4, attached to the blade end 14 of the clipper housing 12 is a bladeset, generally designated 30. In the present embodiment, the bladeset 30 is releasably secured to the clipper housing 12 via fasteners, preferably threaded screws (not shown) which pass through mounting bores 32 on a stationary blade 34 and engage the mounting openings 28. A feature of the present bladeset 30 is that it is releasably attached to the hair clipper housing 12 as a unit by the removal of the two fasteners engaging the mounting openings 28 and the mounting bores 32. The ability to remove the bladeset 30 rapidly is highly desirable, as it is known that hair clipper blades can become hot during operation. When cutting animal fur, a hot blade can cause discomfort to the animal making the hair cutting operation difficult. Therefore, the ability to accomplish a rapid bladeset change by manipulating only two screws provides a distinct advantage to the user.

The stationary blade 34 has a front, stationary toothed edge 36 with a plurality of blade teeth 38, and an opposite, stationary rear edge 40. Also, the stationary blade 34 defines a transverse track 42 on an upper surface 44. While other configurations are contemplated, in the preferred embodiment, the transverse track 42 is recessed from the upper surface 44 and defines a pair of spaced, parallel edges 46.

Also included in the bladeset 30 is a moving blade 50 having a front, moving toothed edge 52 with a plurality of teeth 54 and an opposite, moving rear edge 56. As is well known in the art, hair cutting action is generated by the bladeset 30 due to the reciprocal transverse motion of the moving blade 50 relative to the stationary blade 34 so that hair or fur caught between the respective teeth 38, 54 is cut in a shearing action. It should be noted that the particular geometry shown for teeth 38, 54 is exemplary only, and any tooth configuration could be used.

In the preferred embodiment, the moving blade 50 is stamped rather than cast and machined, which decreases the conventional heavy top blade mass and thus reduces vibrations and the work required in clipping motion of the bladeset 30. Also, a thinner moving blade 50 is a better heat sink, reducing operational heat of the hair clipper 10 and reducing operator fatigue. It is contemplated, however, that traditional moving blade configurations could also be utilized, i.e. a cast, extruded, and/or machined moving blade could also be used.

Referring now to FIGS. 1-4 and 6-8, a lower blade guide 58 is disposed between the moving blade 50 and the stationary blade 34, and is configured for reciprocating in the transverse track 42. As such, the lower blade guide 58 maintains lateral alignment of the moving blade 50 relative to the stationary blade 34 during lateral reciprocating movement of the moving blade, and preserves the cutting action of the respective blade teeth 38, 54. While other configurations are contemplated, the lower blade guide 58 is rectangular and has a ladder-like construction, including a generally centrally-located drive opening 60 having at least one and preferably a plurality of lock formations 62. Upon assembly of the bladeset 30, the lower blade guide 58 moves in the transverse track 42 along with the reciprocation of the moving blade 50 relative to the stationary blade 34.

Referring now to FIGS. 3-5 and 7-8, between the blade edge 52 and the moving blade rear edge 56 on the moving blade 50 is an engagement formation 64 (FIG. 4), which in the preferred embodiment is an opening, however other configurations are contemplated. An upper blade guide 66 has a depending lug or key formation 68 (FIG. 5) which connects with the engagement formation 64 for moving with the moving blade 50 in the above-described lateral reciprocating movement. Further, the key formation 68 is constructed and arranged for matingly engaging the lock formations 62 on the lower blade guide 58, so that the moving blade 50 is operationally sandwiched between the upper blade guide 66 and the lower blade guide 58 for common movement relative to the stationary blade 34. While the key formation 68 and the lock formations 62 are shown mating via a tab and slot style snap arrangement, any mechanical means of connecting the upper blade guide 66 and the lower blade guide 58 to achieve the functionality described herein is contemplated.

Also included on the upper blade guide 66 is a block 70 defining a laterally or horizontally-extending slot 72 constructed and arranged for accommodating a blade end 74 of an elongate drive arm 76. In the preferred embodiment, the blade end 74 is ring-shaped, however other configurations are contemplated as long as the blade end 74 maintains engagement with the slot 72 during an entire reciprocal drive cycle of the drive arm 76. The present configuration is such that the blade end 74 projects through the slot 72 and provides continual contact between the drive arm 76 and the upper blade guide 66 during the entire reciprocal stroke of the moving blade 50. This relatively positive connection reduces operational vibration compared to conventional hair clipper bladesets. Further, the rounded shape of the blade end 74 provides for a smooth sliding engagement within the slot 72, thereby also reducing friction, vibration, and noise.

Opposite the blade end 74, the drive arm 76 features an opposite follower end 78 configured for receiving the eccentric cam drive end 26 (FIG. 2), which is also the hair clipper drive element. In the preferred embodiment, the follower end 78 is clevis-shaped, with a pair of spaced, parallel paddles 80, however other configurations are contemplated. Indeed, any cam follower geometry could be employed which is configured to work with an eccentric cam. Yet further, while a rotary style motor 22 is depicted, it is also conceived that the motor is optionally a pivot style motor, with the follower end 78 being replaced with a magnet carriage of the type used with electromagnetic pivot motors.

Figure 4:
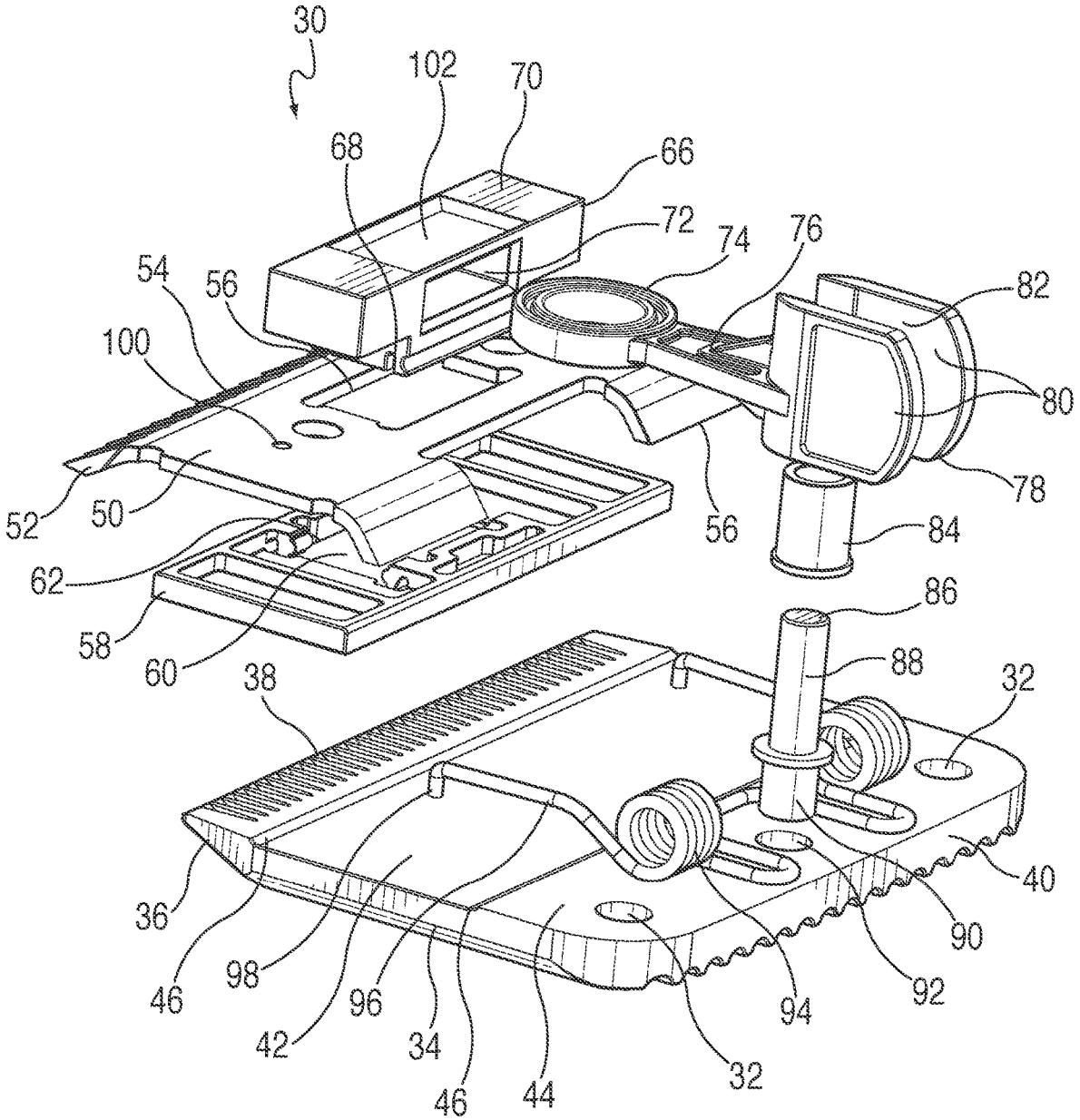
FIG. 4 is a perspective exploded view of the bladeset of FIG. 3.
Figure 5:
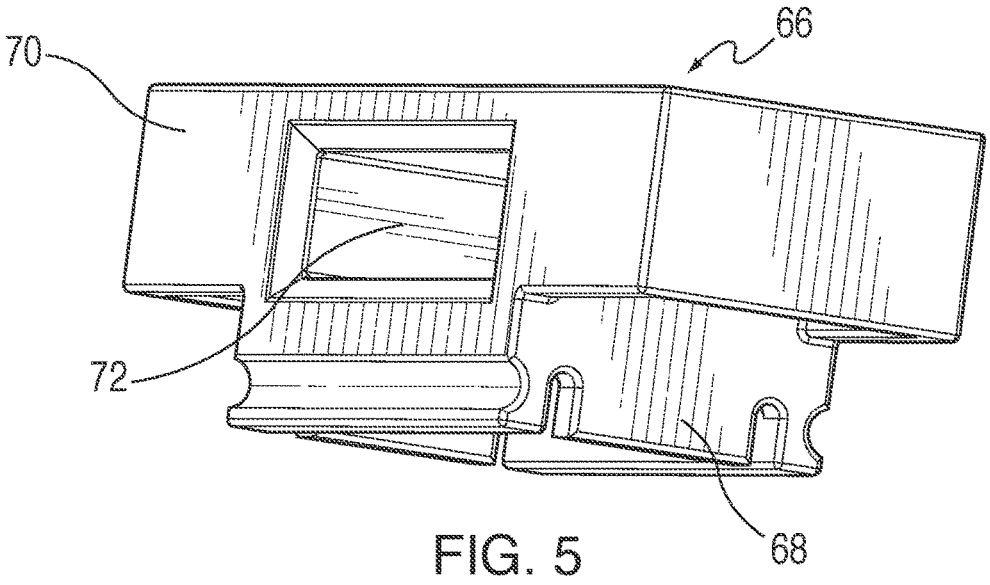
FIG. 5 is a perspective view of an upper blade guide element of a blade guide assembly of the bladeset of FIG. 1.
Figure 6:
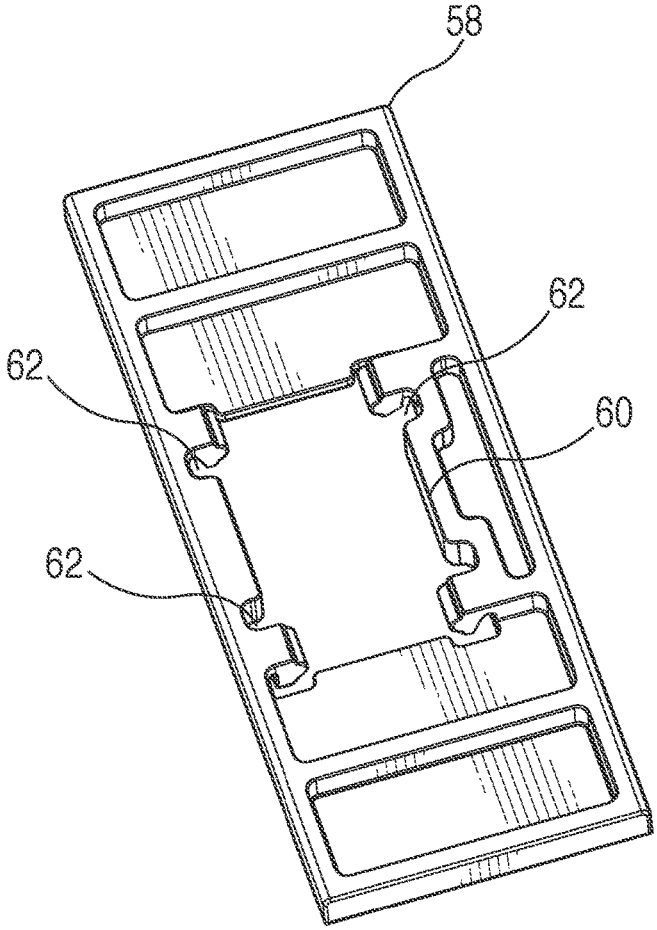
FIG. 6 is a top perspective view of a lower blade guide element of a blade guide assembly of the bladeset of FIG. 1.
Figure 7:
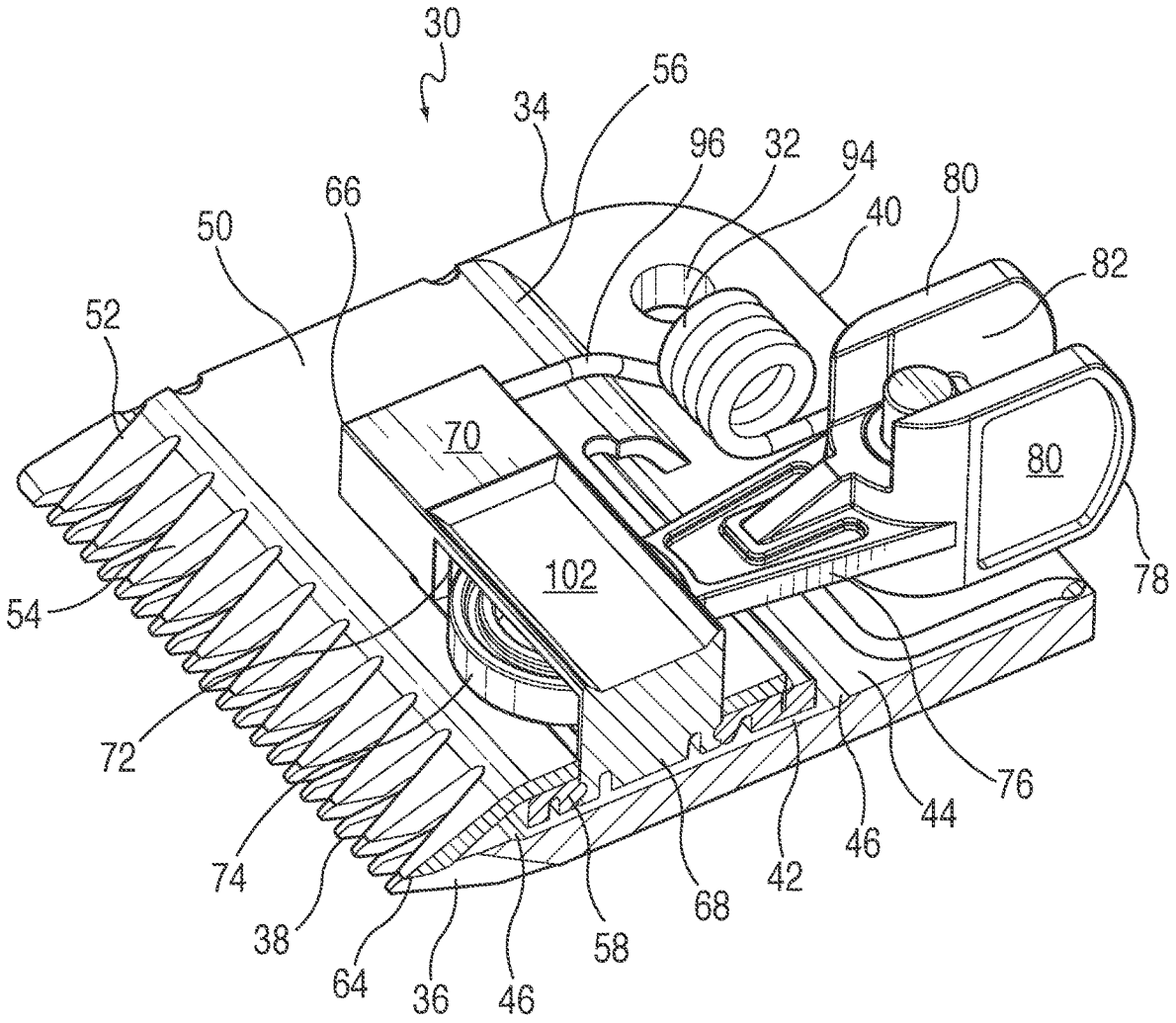
FIG. 7 is a top perspective and vertical cross-section of the bladeset of FIG. 1, illustrating a mating interface between the upper blade guide element of FIG. 5 and the lower blade guide element of FIG. 6.
Figure 8:
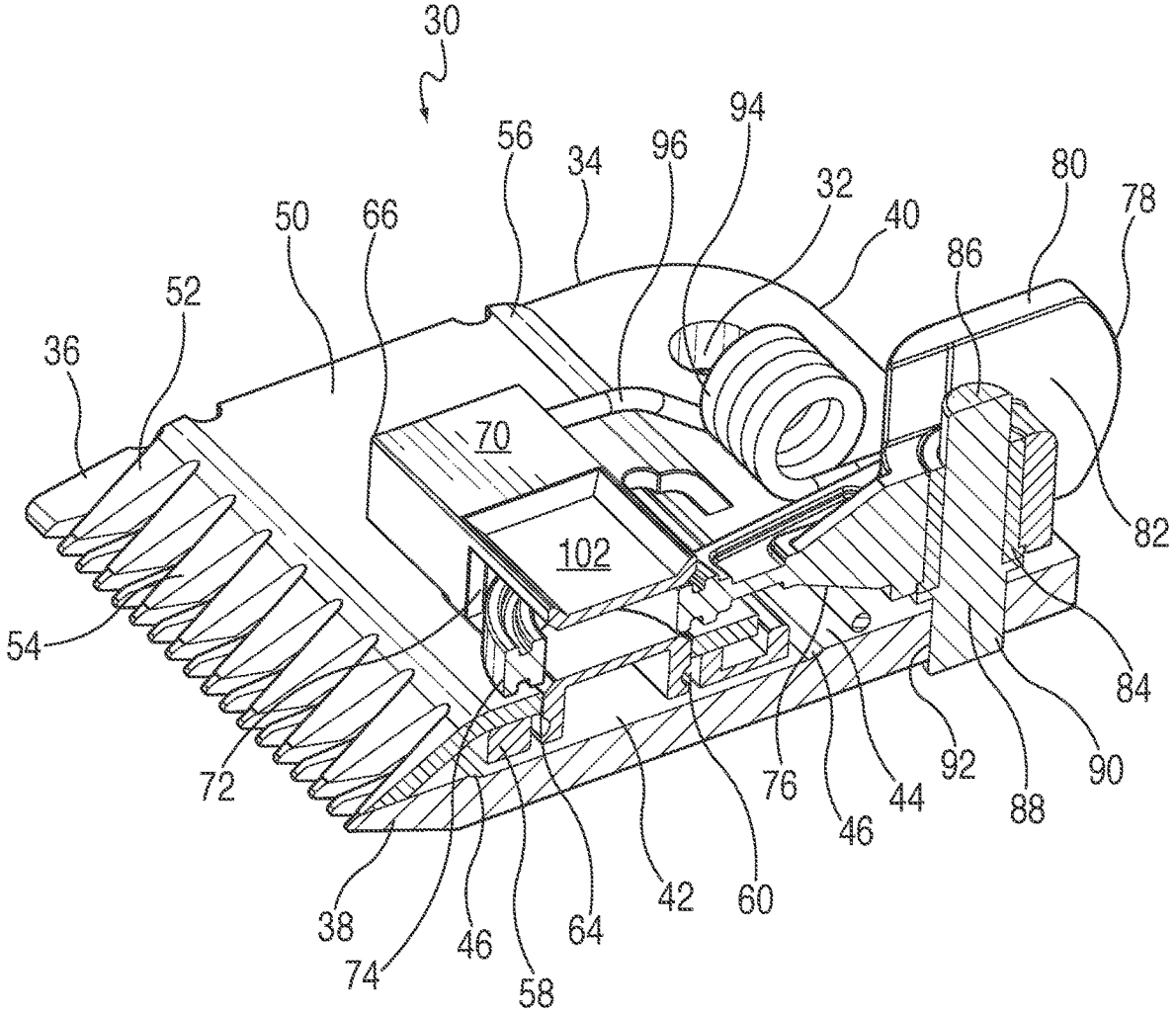
FIG. 8 is a perspective and vertical cross-section of the bladeset of FIG. 1, taken through a central longitudinal axis of a pivot arm of the bladeset illustrating a mating interface between a first end of the pivot arm and the upper blade guide element, as well as a mating interface between a second end of the pivot arm and a drive post and a bushing of the bladeset.

The follower end paddles 80 define an interior 82 dimensioned for accommodating a bushing 84 slidably and rotatably receiving an upper end 86 of a drive post 88. In the preferred embodiment, the bushing 84 is an oil-impregnated bronze type bushing, however alternatives are contemplated. Indeed, any low friction bushing is contemplated. Opposite the upper end 86, the drive post 88 has a lower end 90 contacting the stationary blade 34. As seen in FIG. 4, in the preferred embodiment, the lower end 90 matingly and rotatably engages a socket or throughbore 92 in the stationary blade that is located between the mounting bores 32. This construction makes the bladeset 30 relatively more rigid in construction, and reduces vibration due to manufacturing tolerances of the type experienced in conventional hair clipper bladesets. Thus, the drive post 88 defines a pivot point for the drive arm 76, and rotational friction generated by the action of the drive arm about the drive post 88 is reduced due to the presence of the bushing 84.

Referring now to FIGS. 3-4 and 7-8, included on the bladeset 30 is a spring 94 associated with the stationary blade 34 and having a pair of spaced, generally parallel arms 96 with free ends 98 constructed and arranged for engaging openings 100 in the moving blade 50. As is known in the art, the arms 96 of the spring 94 exert a biasing force on the moving blade 50 to urge it against the stationary blade 34 for enhanced cutting action. The spring 94 is optionally held against the stationary blade 34 using a clip, spot weld, fastener, or any similar structure sufficient to hold the spring 94 in place while allowing it to perform the functionality discussed herein. In the event that additional moving blade holding power is needed, additional pressure is optionally exerted on a recessed panel 102 on the block 70. For non-limiting example, a knob (not shown) is optionally affixed to the housing 12 that, when turned, exerts a downward force against the panel 102. A set screw with a ball bearing at its end is attachable to the knob such that when the knob is twisted, the ball bearing end of the set screw impinges upon the panel 102 to allow for smooth lateral movement of the block 70 while still applying sufficient downward force.

Another feature of the present bladeset 30 is an improved ratio of cam rotation to blade movement. Indeed, conventional bladesets used for animal clipping and shearing have cam driven blade motion using a 1:1 ratio, so that the eccentric driven cam has a lobe that causes rotation of the cam off center the same amount that the moving blade moves in one half of its operational stroke from a middle position to one end of the stationary blade. In the present bladeset 30, to increase the clipping power per drive energy provided by the motor 22, the drive arm 76 is constructed and arranged relative to the drive post 88 or pivot point to provide a ratio of 3:1. This means that rotation of the cam 24 by 0.055 inch generates moving blade movement of 0.165 inch. Accordingly, a smaller motor 22 is optionally used to generate a conventional amount of cutting power, or alternatively, the same size motor generates substantially more cutting power.

Through the use of the present bladeset 30, including the reduction of moving parts, the improved pivot ratio and the inclusion of the drive arm 76 and the drive post 88 as integral parts of the assembly, an improved hair clipper is provided with a smaller motor 22 that, among other things, results in the clipper 10 being 2.5 pounds lighter and 40% shorter than conventional hair clippers used for animal clipping and/or shearing, and has as many as 36 fewer components than conventional bladesets. These changes reduce operational vibration, noise and heat generation.

Figure 9:
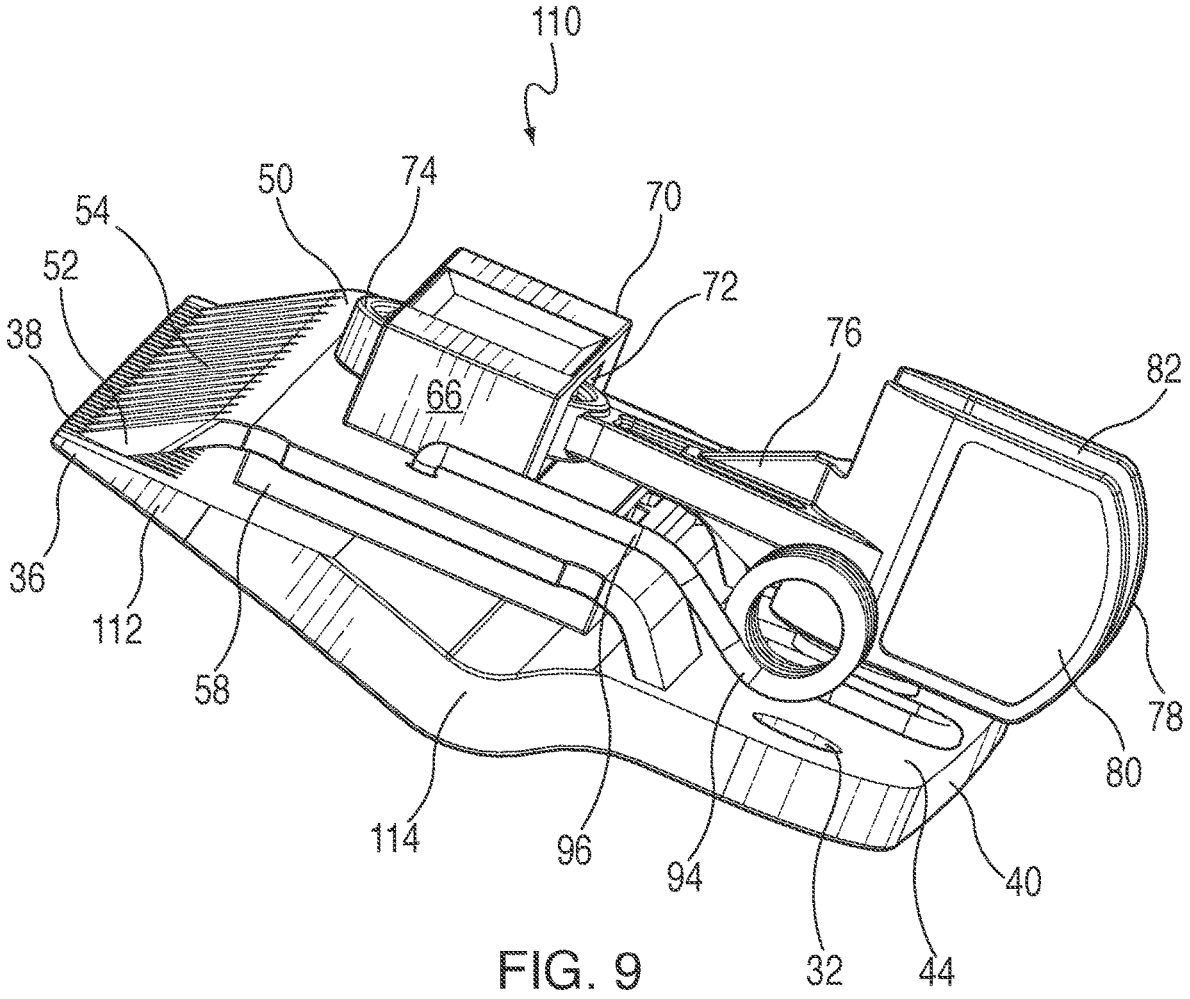
FIG. 9 is a second exemplary embodiment of a bladeset according to the teachings herein.

Referring now to FIG. 9, and alternate embodiment of the present bladeset 30 is designated 110. Components shared with the blade set 30 are designated with identical reference numbers. The main distinction of the bladeset 110 is that a stationary blade 112 is provided with a concave shape defining a transverse track 114 when viewed from the side. As such, the lower blade guide 58 has reduced sliding contact with the stationary blade 112 compared to the bladeset 30. This configuration reduces sliding friction and the heat generated during operation.

Figure 10:
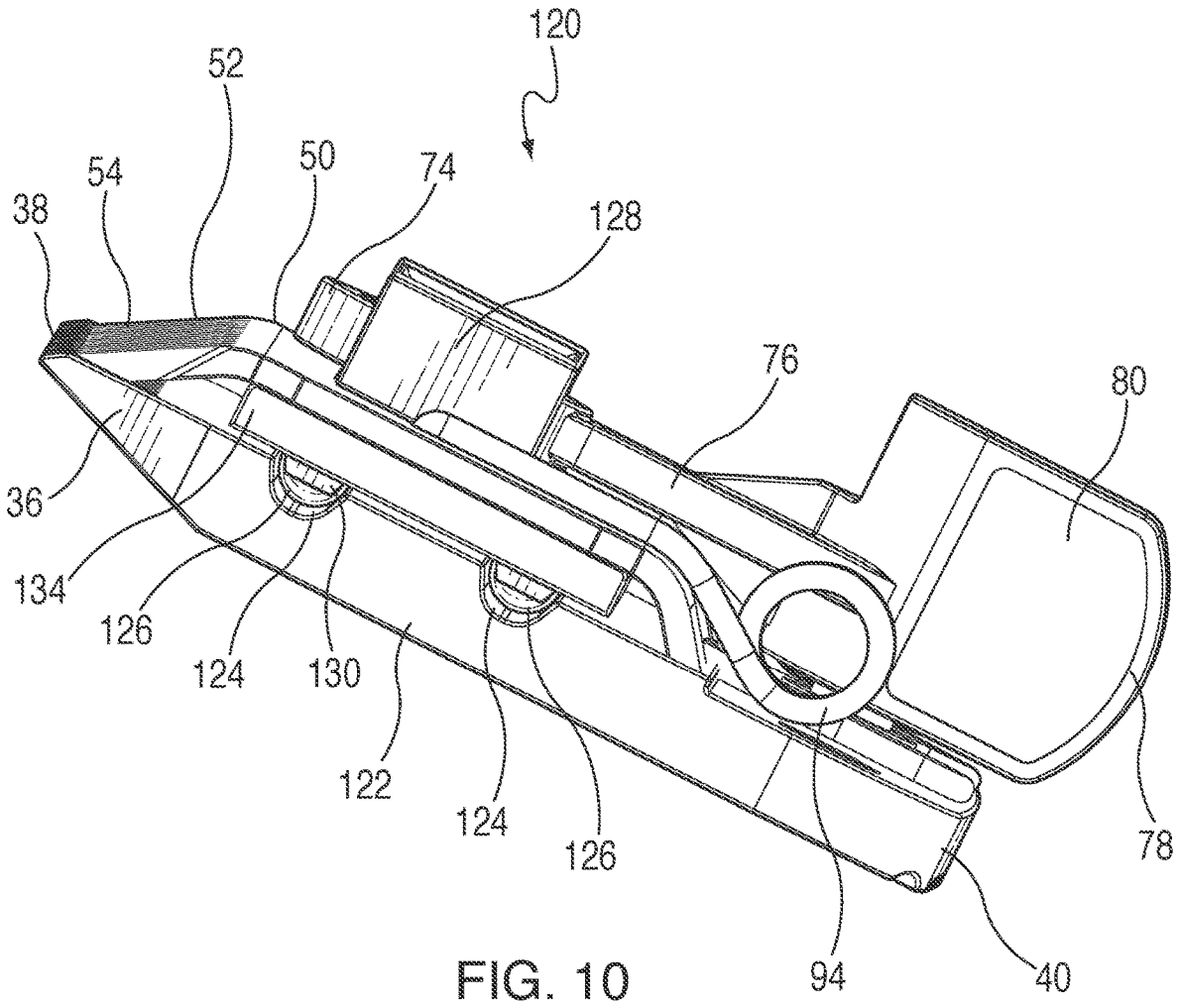
FIG. 10 is a third exemplary embodiment of a bladeset according to the teachings herein.
Figure 11:
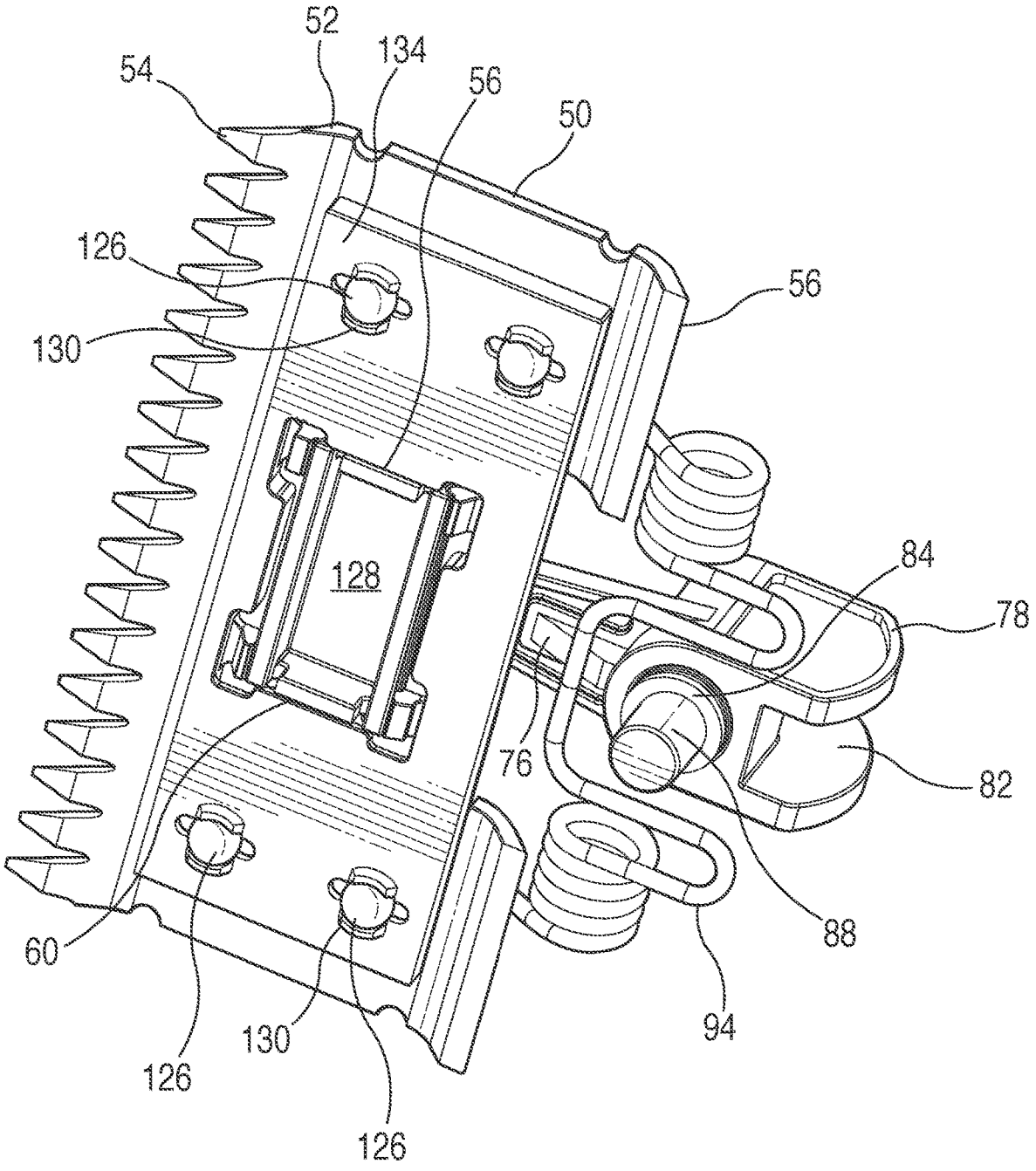
FIG. 11 is a bottom perspective view of the embodiment of FIG. 10.
Figure 12:
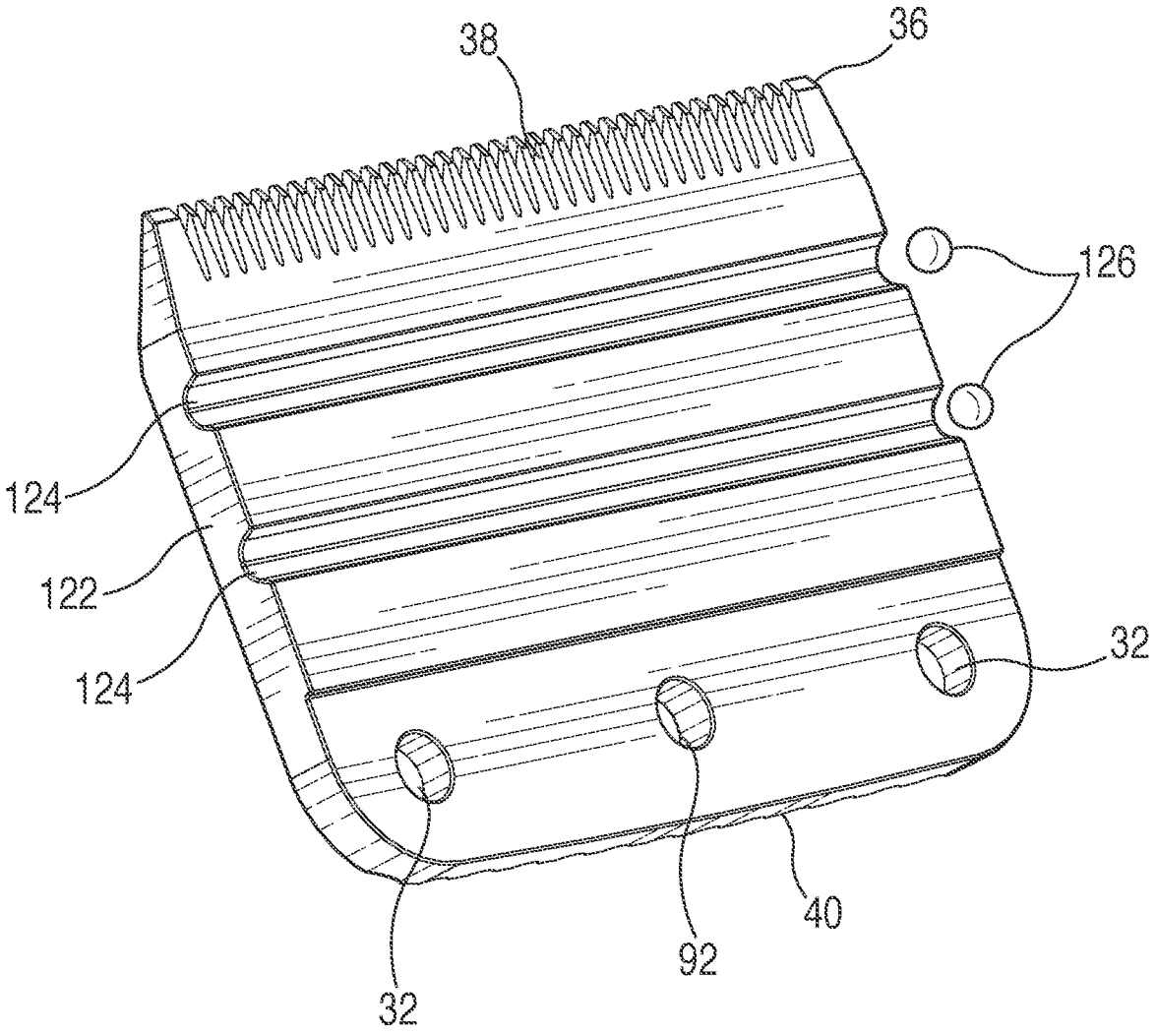
FIG. 12 is a perspective view of the bottom blade of the embodiment of FIG. 10, illustrating a pair of channels arranged to receive the ball bearings or the depending tabs.

Referring now to FIGS. 10-12, another alternate embodiment of the present bladeset is designated 120. Components shared with the bladesets, 30 and 110 are designated with identical reference numbers. A main distinction of the bladeset 120 is that a stationary blade 122 is provided with transverse, concave grooves 124 instead of the recessed transverse track 42 discussed above. These grooves 124 can accommodate ball bearings 126 carried by the lower blade guide 134 for enhancing the reciprocal sliding of the lower blade guide 134. The ball bearings 126 are held in place in the grooves 124 by depending tabs 130 in the lower blade guide 134. The ball bearings 126 are held by the tabs 130 such that they are freely rotatable, and in particular, rotate within the grooves 124 as they move relative thereto.

While a particular embodiment of the present hair clipper bladeset with combined drive elements has been described herein, it will be appreciated by those skilled in the art that changes and modifications may be made thereto without departing from the invention in its broader aspects and as set forth in the following claims.

The invention claimed is:

1. A hair clipper bladeset, comprising:

a stationary blade having a front, stationary toothed edge and an opposite, stationary rear edge, said stationary blade defining a transverse track;

a moving blade having a front, moving toothed edge and an opposite, moving rear edge;

a lower blade guide disposed between said moving blade and said stationary blade and configured for reciprocating in said track and maintaining lateral alignment of said moving blade relative to said stationary blade during lateral reciprocating movement of said moving blade;

said moving blade having an engagement formation;

an upper blade guide connects with said engagement formation for moving with said moving blade in said lateral reciprocating movement;

a drive arm having a blade end operatively engaging said upper blade guide, and an opposite follower end configured for receiving a hair clipper drive element; and said drive arm pivoting about a drive post located on said stationary blade.

2. The hair clipper bladeset of claim 1, wherein said bladeset is constructed and arranged for being removable from a hair clipper as a unit.

3. The hair clipper bladeset of claim 1, wherein a surface of said stationary blade is provided with grooves accommodating at least one ball bearing for reducing friction generated by the reciprocation of said lower blade guide relative to said stationary blade.

4. The hair clipper bladeset of claim 1, wherein said engagement formation of said moving blade is an opening accommodating a depending lug in said upper blade guide.

5. The hair clipper bladeset of claim 1, wherein said upper blade guide includes a slot for accommodating said blade end of said drive arm.

6. The hair clipper bladeset of claim 1, wherein said follower end of said drive arm defines an interior configured for receiving the hair clipper drive element.

7. The hair clipper bladeset of claim 6, further including a bushing mounted on said drive post, and said interior is dimensioned to be sufficiently large for accommodating said bushing.

8. The hair clipper bladeset of claim 7, wherein said bushing is slidably and rotatably mounted upon said drive post.

9. The hair clipper bladeset of claim 1, further including a spring configured for urging said moving blade against said stationary blade.

10. The hair clipper bladeset of claim 1, wherein said stationary blade includes a socket dimensioned for accommodating a lower end of said drive post.

11. The hair clipper bladeset of claim 1, wherein said drive arm operates at a ratio of 3:1 relative to said moving blade.

12. The hair clipper bladeset of claim 11, wherein a rotation of said hair clipper drive element by 0.055 inch generates a movement of said moving blade of 0.165 inch.

13. The hair clipper bladeset of claim 1, wherein said transverse track has a concave shape when viewed from the side of said stationary blade for reducing friction with said lower blade guide.

14. The hair clipper bladeset of claim 1, wherein said stationary blade has at least one groove defining said transverse track, and said upper blade guide has at least one depending tab for slidably engaging said groove for maintaining alignment of said moving blade relative to said stationary blade.

15. A hair clipper, comprising:

a clipper housing;

a drive system mounted within said clipper housing, said drive system including an eccentric cam;

a hair clipper bladeset mounted to said clipper housing, and comprising:

a stationary blade having a front, stationary toothed edge and an opposite, stationary rear edge, said stationary blade defining a transverse track;

a moving blade having a front, moving toothed edge and an opposite, moving rear edge;

a lower blade guide disposed between said moving blade and said stationary blade and configured for reciprocating in said track and maintaining lateral alignment of said moving blade relative to said stationary blade during lateral reciprocating movement of said moving blade;

said moving blade having an engagement formation;

an upper blade guide located in said engagement formation for moving with said moving blade in said lateral reciprocating movement;

a drive arm having a blade end operatively engaging said upper blade guide, and an opposite follower end configured for receiving said eccentric cam; and said drive arm pivoting about a drive post located on said stationary blade.

16. The hair clipper bladeset of claim 15, wherein said drive arm operates at a ratio of 3:1 relative to said moving blade.

17. The hair clipper bladeset of claim 15, further including a spring configured for urging said moving blade against said stationary blade.

18. A hair clipper bladeset, comprising:

a stationary blade having a front, stationary toothed edge and an opposite, stationary rear edge, said stationary blade defining a least one concave groove;

a moving blade having a front, moving toothed edge and an opposite, moving rear edge;

a lower blade guide disposed between said moving blade and said stationary blade and configured for reciprocating in said groove and maintaining lateral alignment of said moving blade relative to said stationary blade during lateral reciprocating movement of said moving blade;

said moving blade having an engagement formation;

an upper blade guide connects with said engagement formation for moving with said moving blade in said lateral reciprocating movement;

a drive arm having a blade end operatively engaging said upper blade guide, and an opposite follower end configured for receiving a hair clipper drive element; and said drive arm pivoting about a drive post located on said stationary blade;

wherein said at least one concave groove accommodates at least one ball bearing for reducing friction generated by the reciprocation of said lower blade guide relative to said stationary blade, wherein at least one depending tab in said lower blade guide holds said at least one ball bearing in place.

19. The hair clipper bladeset of claim 18, wherein said drive arm operates at a ratio of 3:1 relative to said moving blade.

20. The hair clipper bladeset of claim 18, further including a spring configured for urging said moving blade against said stationary blade.

* * * * *